US012760942B2

(12) United States Patent
Gluesenkamp et al.

(10) Patent No.: US 12,760,942 B2
(45) Date of Patent: Oct. 13, 2026

(54) PACKAGED MULTI-FUNCTIONAL AIR SOURCE HEAT PUMP INTEGRATED WITH A HYDRONIC LOOP FOR COOLING/HEATING ENERGY STORAGE

(71) Applicant: UT-Battelle, LLC, Oak Ridge, TN (US)

(72) Inventors: Kyle R. Gluesenkamp, Oak Ridge, TN (US); Bo Shen, Oak Ridge, TN (US); Zhenning Li, Knoxville, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 0 days.

(21) Appl. No.: 19/138,830

(22) PCT Filed: Feb. 16, 2024

(86) PCT No.: PCT/US2024/016070
§ 371 (c)(1),
(2) Date: Jun. 13, 2025

(87) PCT Pub. No.: WO2024/173741
PCT Pub. Date: Aug. 22, 2024

(65) Prior Publication Data

US 2026/0029144 A1 Jan. 29, 2026

Related U.S. Application Data

(60) Provisional application No. 63/446,366, filed on Feb. 17, 2023.

(51) Int. Cl.
*F25B 13/00* (2006.01)
*F24D 3/18* (2006.01)
(Continued)

(52) U.S. Cl.
CPC ..... *F25B 13/00* (2013.01); *F24D 3/18* (2013.01); *F24D 17/0036* (2013.01);
(Continued)

(58) Field of Classification Search
CPC ..... F25B 2313/02742; F25B 2313/003; F25B 2313/004; F25B 2339/046;
(Continued)

(56) References Cited

U.S. PATENT DOCUMENTS 5,355,688 A * 10/1994 Rafalovich ..... F24D 11/0214 62/430
5,575,159 A * 11/1996 Dittell ..... F25B 6/04 62/201
(Continued)

FOREIGN PATENT DOCUMENTS

| | | | |
|---|---|---|---|
| CN | 114593477 | A | 6/2022 |
| EP | 4033179 | A1 | 7/2022 |
| KR | 20070022941 | A | 2/2007 |

OTHER PUBLICATIONS

The International Search Report of the International Searching Authority for Application No. PCT/US2024/016070 mailed Jun. 20, 2024 (2 pages).
(Continued)

*Primary Examiner* — Christopher R Zerphey
(74) *Attorney, Agent, or Firm* — WARNER NORCROSS + JUDD LLP

(57) ABSTRACT

An improved ASHP having an integrated hydronic loop for thermal energy storage is provided. The hydronic loop includes a phase change material storage module to release energy capacity during peak electricity hours. The ASHP further includes an indoor air-to-refrigerant heat exchanger, an outdoor air-to-refrigerant heat exchanger, a refrigerant-to-water heat exchanger, three electronic expansion valves
(Continued)

to control refrigerant flow, and a multi-capacity compressor with a suction line accumulator to store excess refrigerant charge. The ASHP includes at least six working modes of operation, including: (1) space cooling mode; (2) cooling energy charge/simultaneous space cooling and cooling energy charge/defrost mode; (3) cooling storage discharge mode; (4) space heating mode; (5) heating energy charge mode; and (6) heating storage discharge mode. This and other embodiments are uniquely suited for residential space cooling, space heating, water heating, and commercial applications with high water heating and space cooling demands.

22 Claims, 7 Drawing Sheets

(51) Int. Cl.

| | |
|---|---|
| ***F24D 17/00*** | (2022.01) |
| ***F24F 5/00*** | (2006.01) |
| ***F24F 11/50*** | (2018.01) |
| ***F25B 25/00*** | (2006.01) |
| ***F25B 41/20*** | (2021.01) |
| ***F25B 41/325*** | (2021.01) |
| ***F25B 49/02*** | (2006.01) |

(52) U.S. Cl.
CPC ..... *F24F 5/0017* (2013.01); *F25B 25/005* (2013.01); *F25B 41/20* (2021.01); *F25B 41/325* (2021.01); *F25B 49/02* (2013.01); *F24D 2220/10* (2013.01); *F24F 11/50* (2018.01); *F25B 2313/02742* (2013.01); *F25B 2313/0292* (2013.01); *F25B 2339/047* (2013.01); *F25B 2400/0411* (2013.01); *F25B 2400/24* (2013.01)

(58) Field of Classification Search
CPC ..... F25B 2339/047; F25B 2400/24; F24F 5/0017; F24F 5/0021; F24F 2005/0025; F24F 2005/0028; F24F 2005/0032
See application file for complete search history.

(56) References Cited

U.S. PATENT DOCUMENTS

| | | | | |
|---|---|---|---|---|
| 7,152,413 | B1 * | 12/2006 | Anderson | F24D 17/02 62/118 |
| 7,757,508 | B2 * | 7/2010 | Ally | F28D 20/0052 62/93 |
| 9,644,876 | B2 * | 5/2017 | Tamaki | F24H 15/38 |
| 9,822,996 | B2 * | 11/2017 | Deng | F25B 47/02 |
| 9,970,688 | B2 * | 5/2018 | Park | F25B 49/02 |
| 10,281,180 | B2 * | 5/2019 | Ma | F25B 40/02 |

OTHER PUBLICATIONS

F. Souayfane, F. Fardoun and P.-H. Biwole, "Phase change materials (PCM) for cooling applications in buildings: A review," Energy and Buildings, vol. 129, pp. 396-431, 2016.
A. Eddhahak-Ouni, J. Colin and D. Bruneau, "On an experimental innovative setup for the macro scale thermal analysis of materials: Application to the Phase Change Material (PCM) wallboards," Energy and Buildings, vol. 64, pp. 231-238, 2013.
K. Biswas, J. Lu, P. Soroushian and S. Shrestha, "Combined experimental and numerical evaluation of a prototype nano-PCM enhanced wallboard," Applied Energy, vol. 131, pp. 517-529, 2014.
K. O. Lee, M. A. Medina, E. Raith and X. Sun, "Assessing the integration of a thin phase change material (PCM) layer in a residential building wall for heat transfer reduction and management," Applied Energy, vol. 137, pp. 699-706, 2015.
D. Neeper, "Thermal dynamics of wallboard with latent heat storage," Solar Energy, vol. 68, No. 5, pp. 393-403, 2000.
S. Álvarez, L. F. Cabeza, A. Ruiz-Pardo, A. Castell and J. A. Tenorio, "Building integration of PCM for natural cooling of buildings," Applied Energy, vol. 109, pp. 514-522, 2013.
D.-I. Bogatu, O. B. Kazanci and B. W. Olesen, "An experimental study of the active cooling performance of a novel radiant ceiling panel containing phase change material (PCM)," Energy and Buildings, vol. 243, p. 110981, 2021.
A. de Gracia, C. Fernández, A. Castell, C. Mateu and L. F. Cabeza, "Control of a PCM ventilated facade using reinforcement learning techniques," Energy and Buildings, vol. 106, pp. 234-242, 2015.
M. Fiorentini, J. Wall, Z. Ma, J. H. Braslavsky and p. Cooper, "Hybrid model predictive control of a residential HVAC system with on-site thermal energy generation and storage," Applied Energy, vol. 187, pp. 465-479, 2017.
G. Serale, M. Fiorentini, A. Capozzoli, p. Cooper and M. Perino, "Formulation of a model predictive control algorithm to enhance the performance of a latent heat solar thermal system," Energy Conversion and Management, vol. 173, pp. 438-449, 2018.
G. Gholamibozanjani, J. Tarragona, A. de Gracia, C. Fernández, L. F. Cabeza and M. M. Farid, "Model predictive control strategy applied to different types of building for space heating," Applied Energy, vol. 231, pp. 959-971, 2018.
C. R. Touretzky and M. Baldea, "A hierarchical scheduling and control strategy for thermal energy storage systems," Energy and Buildings, vol. 110, pp. 94-107, 2016.
C. Dullinger, W. Struckl and M. Kozek, "A general approach for mixed-integer predictive control of HVAC systems using MILP," Applied Thermal Engineering, vol. 128, pp. 1646-1659, 2018.
J. Sanchez, Z. Jiang and J. Cai, "Modelling and mitigating lifetime impact of building demand responsive control of heating, ventilation and air-conditioning systems," Journal of Building Performance Simulation, vol. 15, No. 6, pp. 771-787, 2022.
J. Cai, H. Zhang and X. Jin, "Aging-aware predictive control of PV-battery assets in buildings.," Applied Energy, vol. 236, pp. 478-488, 2019.
Z. Jiang, P. Hlanze and J. Cai, "Optimal predictive control of phase change material-based energy storage in buildings via mixed-integer convex programming," Applied Thermal Engineering, vol. 215, p. 118821, 2022.
Y. Lu, S. Wang, Y. Sun and C. Yan, "Optimal scheduling of buildings with energy generation and thermal energy storage under dynamic electricity pricing using mixed-integer nonlinear programming," Applied Energy, vol. 147, pp. 49-58, 2015.
S. N. Al-Saadi and Z. J. Zhai, "Modeling phase change materials embedded in building enclosure: A review," Renewable and Sustainable Energy Reviews, vol. 21, pp. 659-673, 2013.
J. Cai and J. Braun, "An inverse hygrothermal model for multi-zone buildings," Journal of Building Performance Simulation, vol. 9, No. 5, pp. 510-528, 2016.
B. Shen, J. New and V. Baxter, "Air source integrated heat pump simulation model for EnergyPlus," Energy and Buildings, vol. 156, pp. 197-206, 2017.

* cited by examiner

Dedicated Cooling-Energy Charge, Simultaneous Space Cooling and Cooling-Energy Charge, and Heating Mode Outdoor Defrost

PACKAGED MULTI-FUNCTIONAL AIR SOURCE HEAT PUMP INTEGRATED WITH A HYDRONIC LOOP FOR COOLING/HEATING ENERGY STORAGE

CROSS-REFERENCE TO RELATED APPLICATIONS

This application claims the benefit of U.S. Provisional Application 63/446,366, filed Feb. 17, 2023, the disclosure of which is incorporated by reference in its entirety.

STATEMENT REGARDING FEDERALLY SPONSORED RESEARCH AND DEVELOPMENT

This invention was made with government support under Contract No. DE-AC05-00OR22725 awarded by the U.S. Department of Energy. The government has certain rights in the invention.

FIELD OF THE INVENTION

The present invention relates to heat pumps, and in particular, air-source heat pumps integrated with a hydronic loop.

BACKGROUND OF THE INVENTION

An air-source heat pump (ASHP) is a heating and cooling system that transfers heat between indoor air and outdoor air to provide heating or cooling for a building. ASHPs are regarded as energy-efficient because they move heat rather than generate heat directly, making ASHPs more environmentally friendly than traditional heating systems. One example of an ASHP is shown in FIG. 1. This ASHP includes an indoor air-to-refrigerant heat exchanger 10, and outdoor air-to-refrigerant heat exchanger 12, a compressor 14, a four-way valve 16, a suction line accumulator 18, and two single direction thermal-expansion valves 20, 22. The accumulator 18 operates to store liquid refrigerant and prevent liquid refrigerant from entering the compressor 14 at start-up, and the thermal-expansion valves 20, 22 operate to throttle refrigerant flow.

The foregoing ASHP operates on the principle of extracting heat from the outside air and transferring it inside, or vice versa, depending on whether the system is in a heating mode or a cooling mode. In a heating mode, the ASHP extracts heat from the outside air, even if the outside air is below freezing. The refrigerant absorbs this heat via the outdoor heat exchanger 12, which is then compressed, raising its temperature. The heat is released inside the building through the indoor heat exchanger 10, providing warmth. In cooling mode, this process is reversed. The ASHP extracts heat from inside the building and releases it outside, cooling the indoor space.

Existing ASHPs can be used to pre-heat or pre-cool buildings during off-peak hours, particularly to shift loads from peak hours and to reduce overall utility costs. However, pre-heating or pre-cooling causes discomfort due to overheating or overcooling of living spaces. In addition, the storage process through the zone air is slow and inefficient. Accordingly, there remains a continued need for an improved ASHP having an integrated thermal storage capability that is responsive to an electrical grid and that reduces utility costs across a range of heating and cooling modes of operation.

SUMMARY OF THE INVENTION

An improved ASHP having an integrated hydronic loop for thermal energy storage is provided. The hydronic loop is configured to charge or discharge a phase change material (PCM) contained within a suitable storage module. The ASHP includes two series-connected four-way reversing valves to alter refrigerant flow in various operating modes. The ASHP also includes three electronic expansion valves and a suction line accumulator to control optimum subcooling and superheat degrees and to manage charge allocation across six operating modes.

In one embodiment, the PCM storage module is configured to release thermal energy capacity during peak electricity hours. The ASHP also includes parallel condensers/evaporators via two four-way valves connected in series to control refrigerant flow paths. The ASHP further includes an indoor air-to-refrigerant heat exchanger, an outdoor air-to-refrigerant heat exchanger, a refrigerant-to-water heat exchanger, three expansion valves to control refrigerant to the three heat exchangers, a compressor, and a suction line accumulator to store excess refrigerant charge.

The ASHP includes at least six working modes of operation, including: (1) space cooling mode; (2) cooling energy charge/defrost mode; (3) cooling storage discharge mode; (4) space heating mode; (5) heat energy charge mode; and (6) heating storage discharge mode. In certain modes of operation, water within the hydronic loop transfers heat to and from the PCM (contained within the PCM storage module) to absorb or release significant amounts of heat during a phase transition of the PCM, such as changing from a solid to a liquid or vice versa. That is, the PCM absorbs or releases heat during its phase transition, helping to store or release energy. The PCM storage module is optionally a PCM storage tank or PCM panels in building floors, walls, or drop ceilings. Suitable PCMs can include, for example, water, glycerol, salt hydrates, or paraffin wax, by non-limiting example. Glycerol can also be mixed with water or used in its pure form, having a relatively low melting point. Salt hydrates can include for example sodium sulfate decahydrate and magnesium sulfate heptahydrate. Other PCMs can be used in other embodiments.

These and other embodiments are well suited for residential space cooling and space heating, as well as commercial applications with high space heating and space cooling demands, such as restaurants, hotels, and hospitals. As building materials become increasingly lightweight, the building thermal inertia can be increased by incorporating PCMs into the building envelope, e.g., floors, walls, and drop ceilings. In addition, PCMs possess high thermal energy density and possess an isothermal behavior during melting and solidification. As a result, PCMs can serve as an infinite energy reservoir, enabling distributed resource integration and new non-traditional energy storage techniques to shift peak loads and to increase energy efficiency.

These and other features and advantages of the present invention will become apparent from the following description of the invention, when viewed in accordance with the accompanying drawings and appended claims.

DETAILED DESCRIPTION OF THE CURRENT EMBODIMENT

The current embodiment is directed to an air-source heat pump (ASHP) having an integrated hydronic loop to charge or discharge a phase change material (PCM) contained within a suitable storage module. As generally set forth below, the ASHP includes two series-connected four-way reversing valves to alter refrigerant flow in various operating modes. The ASHP also includes three electronic expansion valves and a suction line accumulator to control optimum subcooling and superheat degrees and to manage charge allocation across six operating modes.

Figure 1:
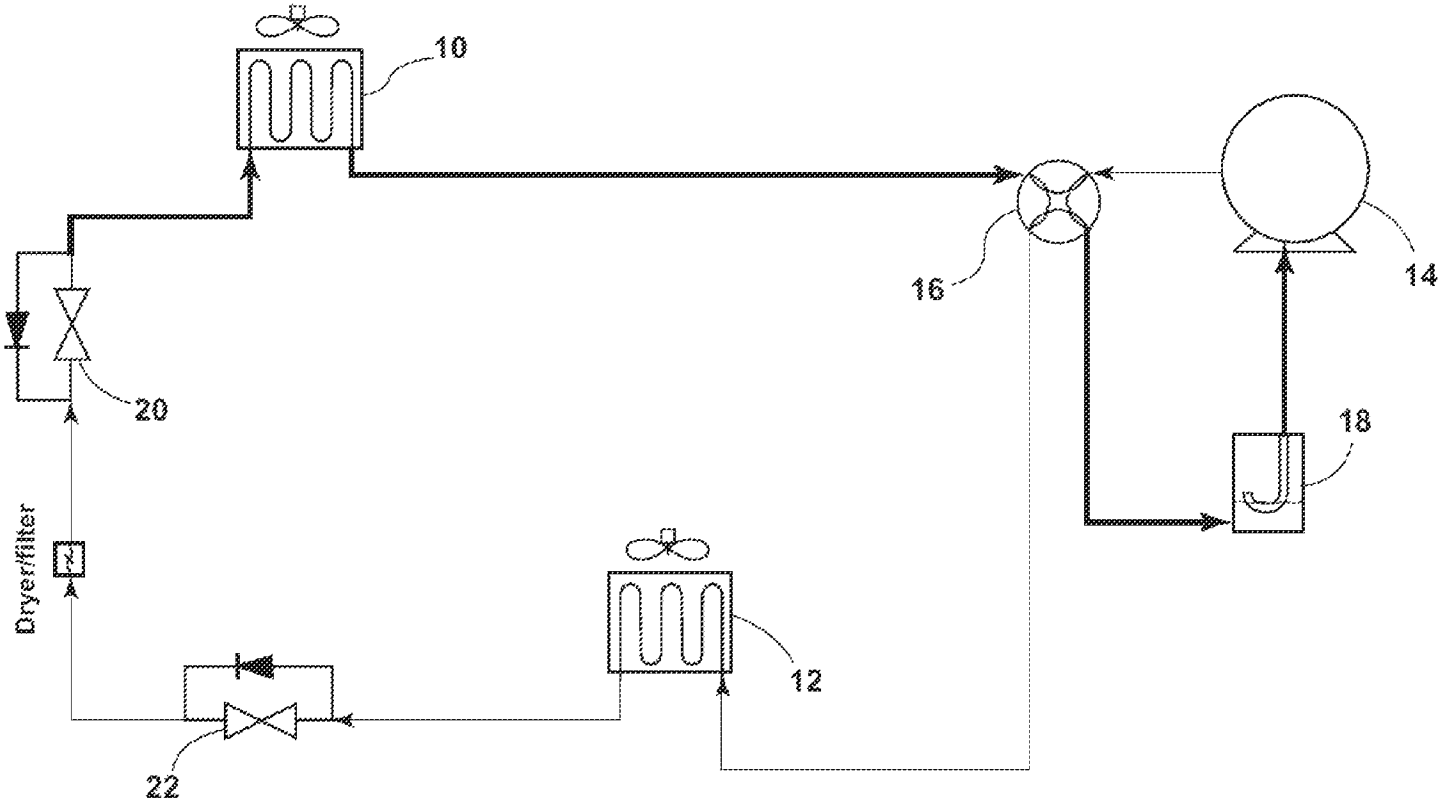
FIG. 1 (PRIOR ART)
FIG. 1 illustrates a prior art air-source heat pump for transferring heat between indoor air and outdoor air.
Figure 2:
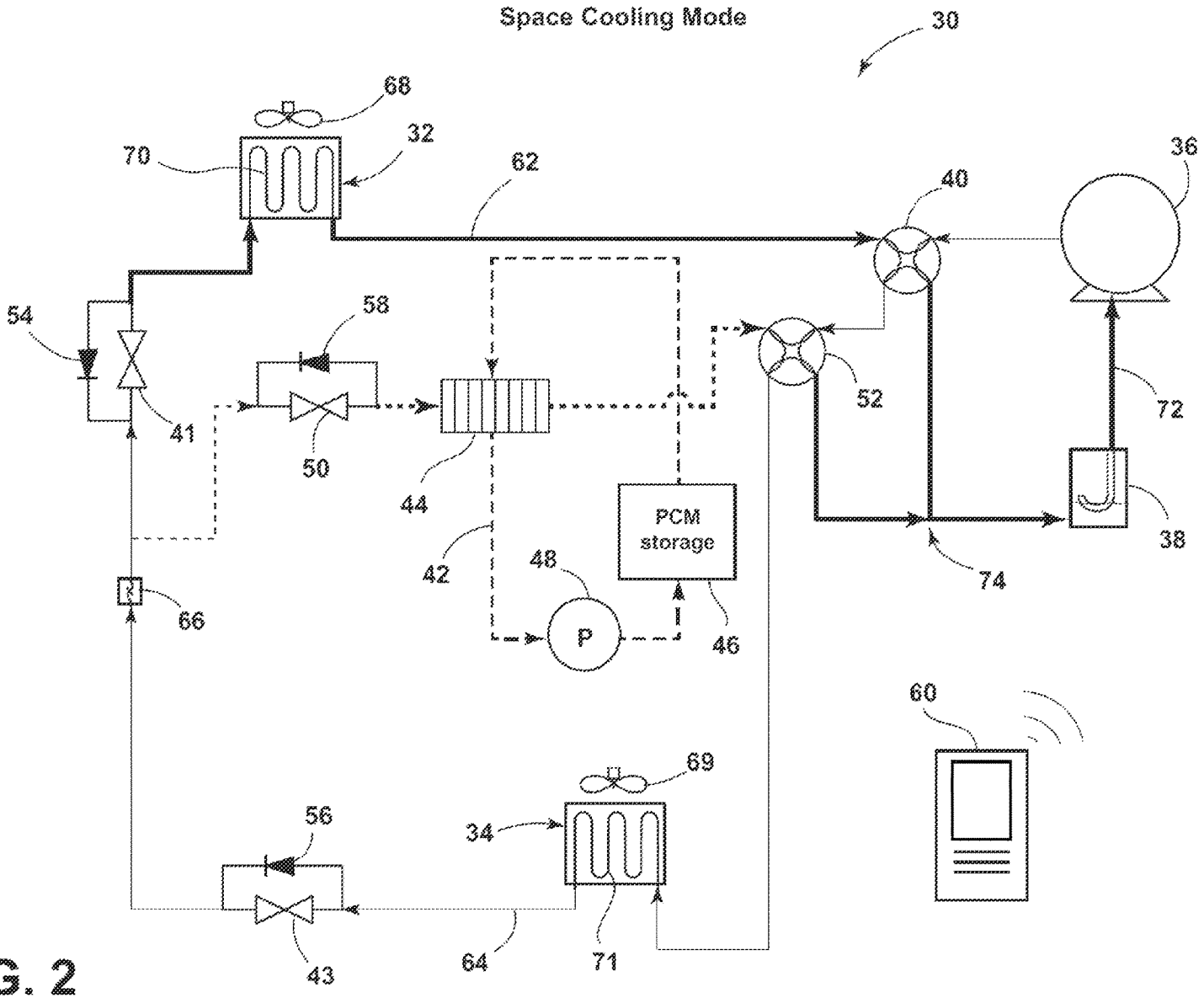
FIG. 2 illustrates an improved air-source heat pump having an integrated hydronic loop having a phase change material in a space cooling mode of operation.
Figure 3:
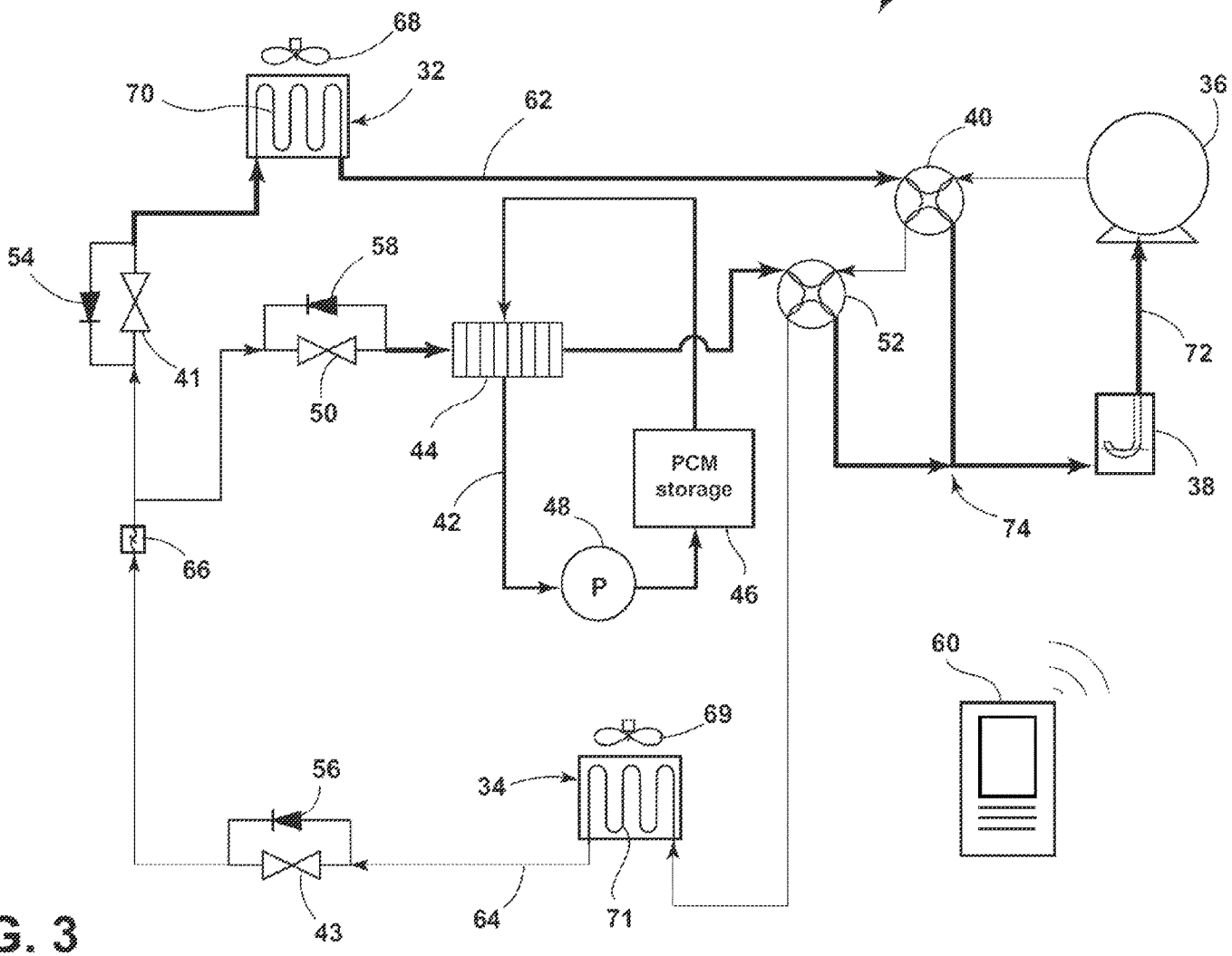
FIG. 3 illustrates the heat pump of FIG. 2 in dedicated cooling-energy charge, simultaneous space cooling and cooling-energy charge, and heating mode outdoor defrost modes of operation.
Figure 4:
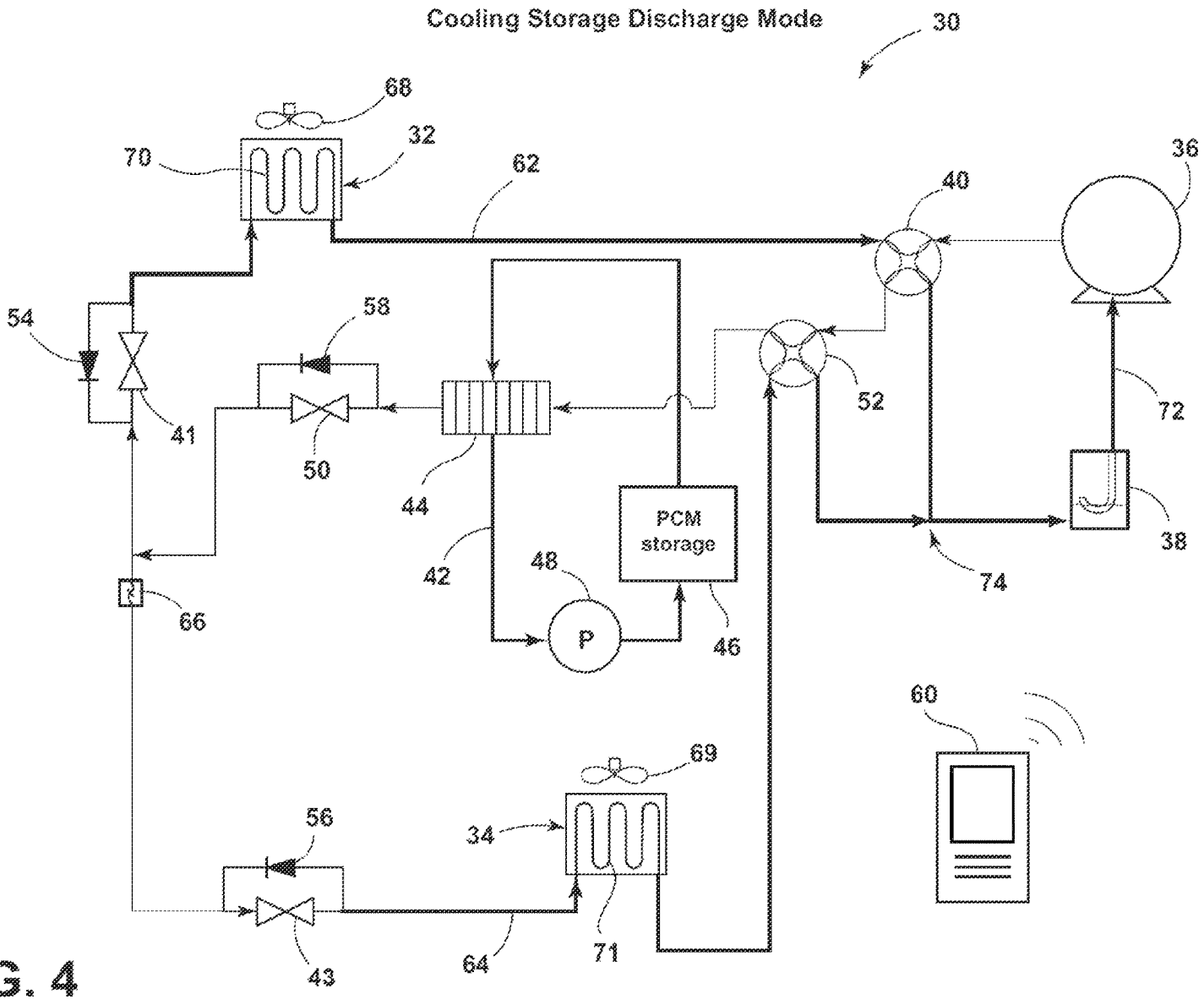
FIG. 4 illustrates the heat pump of FIG. 2 in cooling storage discharge mode of operation.
Figure 5:
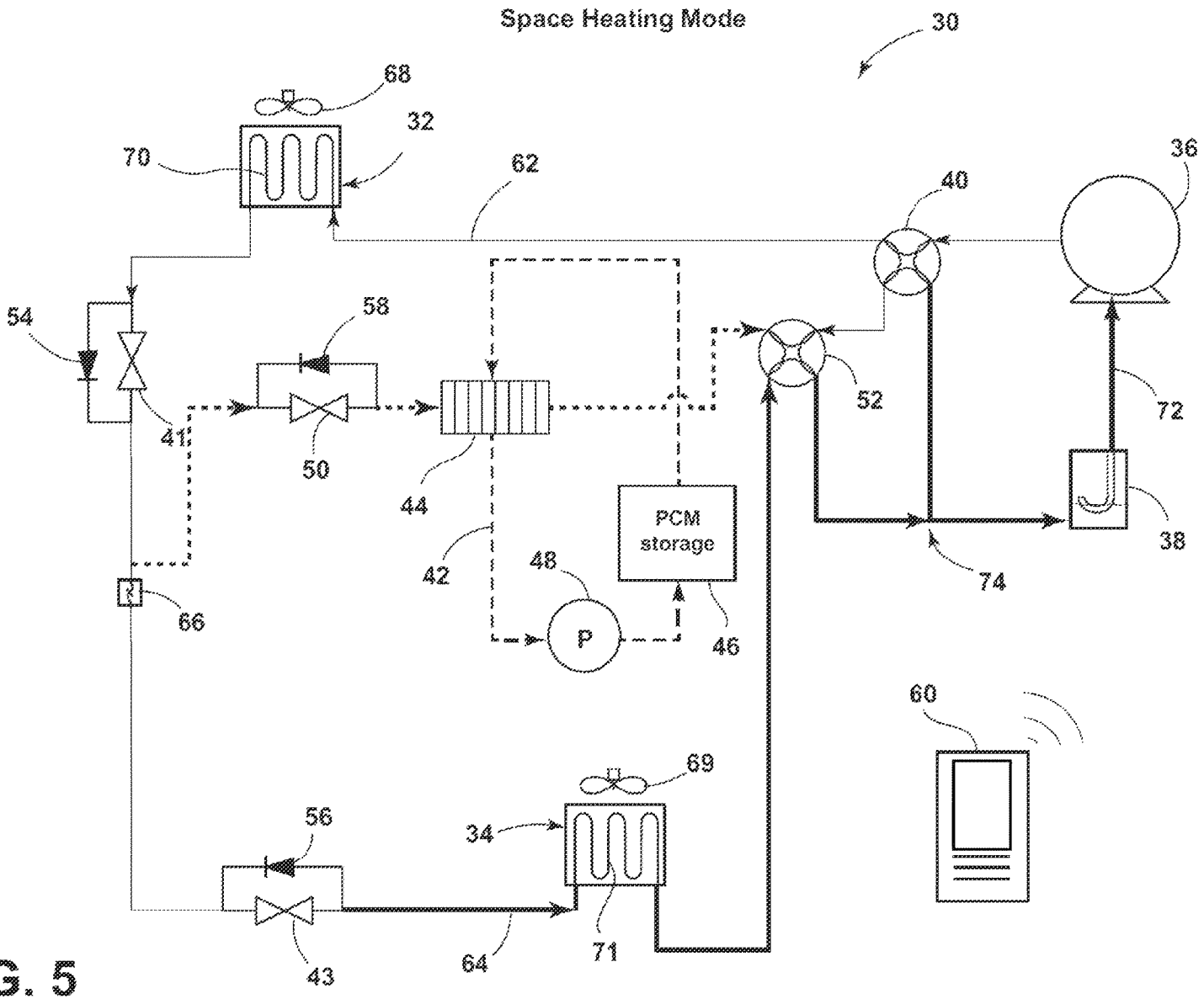
FIG. 5 illustrates the heat pump of FIG. 2 in a space heating mode of operation.
Figure 6:
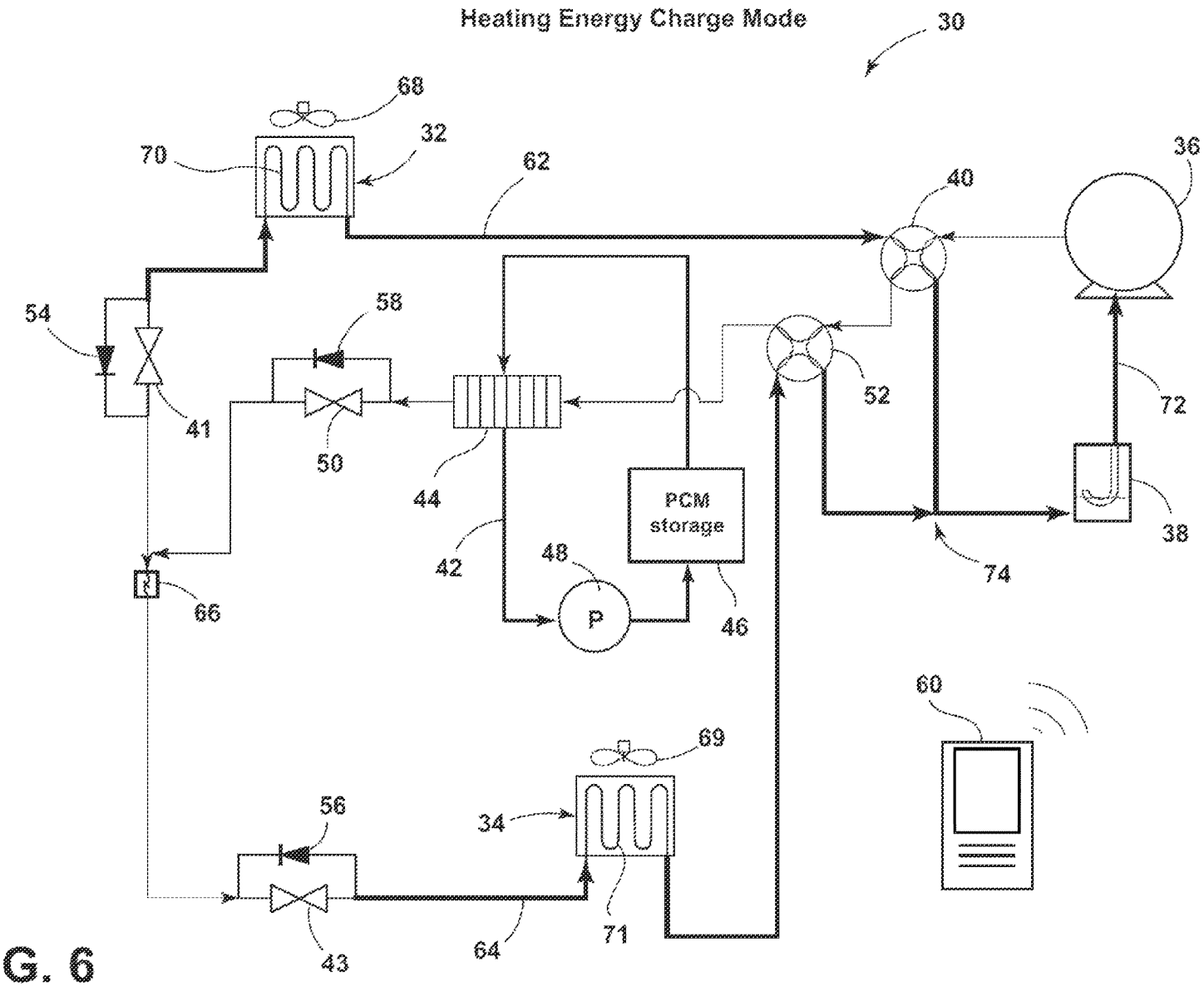
FIG. 6 illustrates the heat pump of FIG. 2 in a heat energy charge mode of operation.
Figure 7:
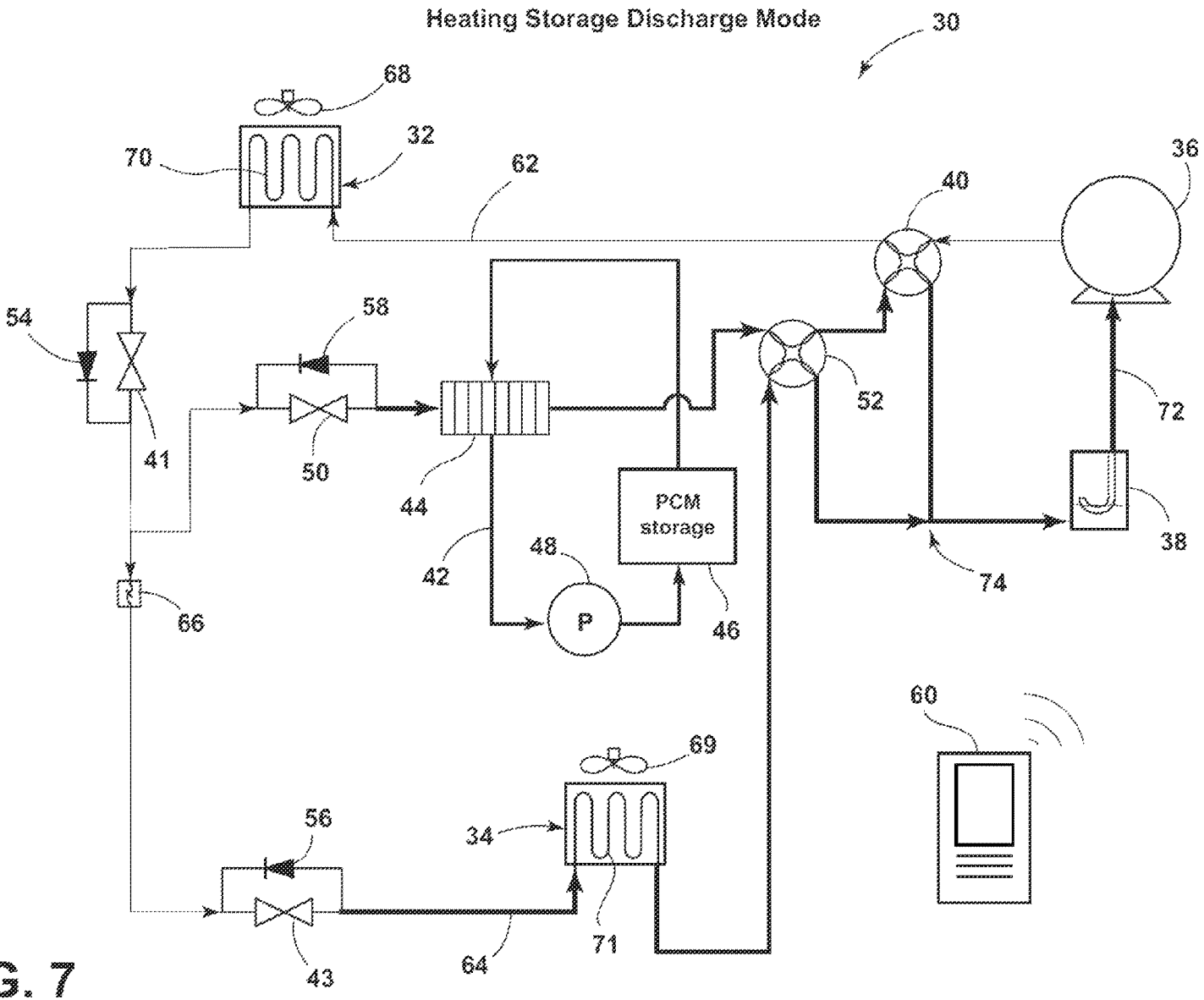
FIG. 7 illustrates the heat pump of FIG. 2 in a heating storage discharge mode of operation.

More specifically, an ASHP having an integrated hydronic loop in accordance with one embodiment is shown in FIGS. 2-7 and generally designated 30. The ASHP 30 includes an indoor air-to-refrigerant heat exchanger 32, an outdoor air-to-refrigerant heat exchanger 34, a compressor 36, a suction line accumulator 38, a first four-way reversing valve 40, and first and second electronic-expansion valves 41, 43. The ASHP 30 further includes a hydronic loop 42 for storing energy within a phase change material (PCM). The hydronic loop 42 includes a water-to-refrigerant heat exchanger 44, a storage module 46 for the PCM, and a pump 48 for circulating water through the hydronic loop 42. The hydronic loop 42 is configured to circulate water through a closed loop to facilitate the storage of energy, depending on the particular mode of operation, and hydronic loop 42 is coupled to the ASHP 30 via three electronic expansion valves 41, 43, 50 and a second four-way reversing valve 52. Each electronic expansion valve 41, 43, 50 is parallel connected to a respective optional check valve 54, 56, 58. The integrated charge management system also includes control circuity (e.g., a digital thermostat having a graphical user interface) 60 communicatively coupled with the pump 48, the four-way reversing valves 40, 52 and the electronic expansion valves 41, 43, 50 to selectively configure the four-way reversing valves 40, 52 and the electronic expansion valves 41, 43, 50 and to cause the ASHP 30 to be operative across each of six modes of operation.

The indoor heat exchanger 32 and the first electronic expansion valve 41 are series connected along an indoor line 62, while the outdoor heat exchanger 34 and the second electronic expansion valve 43 are series connected along an outdoor line 64. The indoor line 62 and the outdoor line 64 include an enclosed passageway through which refrigerant flows. The heat exchangers 32, 34 include any construction adapted to transfer heat between a first medium (e.g., refrigerant) and a second medium (e.g., air). The outdoor line 64 includes a filter or a dryer 66 that is series connected between the first electronic expansion valve 41 and the second expansion valve 43, and the heat exchangers 32, 34 each include a fan 68, 69 to direct the flow of air over a coil 70, 71.

The compressor 36 and the suction line accumulator 38 are series connected along a compressor suction line 72. The output of the compressor 36 flows through to the first four-way reversing valve 40. The hydronic loop 42 includes any suitable air-to-water heat exchanger 44, for example a brazed plate heat exchanger. The output of the air-to-water heat exchanger 44 is coupled along the hydronic loop 42 to the PCM storage module 46.

Each reversing valve 40, 52 can selectively control the flow of refrigerant between four ports. In some embodiments, the reversing valves 40, 52 are operated by an electromechanical solenoid that is movable between four positions. The first reversing valve 40 includes four ports (described herein in clockwise fashion for convenience): a first port in fluid communication with the compressor 36; a second port in fluid communication with a T-junction 74 between the second reversing valve 52 and the suction line accumulator 38; a third port in fluid communication with the second reversing valve 52; and a fourth port in fluid communication with the indoor refrigerant-to-air heat exchanger 32. The second reversing valve 52 includes four ports: a first port in fluid communication with the third port of the first reversing valve 40; a second port in fluid communication with the aforementioned T-junction 74; a third port in fluid communication with the outdoor heat exchanger 34; and a fourth port in fluid communication with the refrigerant-to-water heat exchanger 44.

The ASHP 30 and the integrated hydronic loop 42 comprise a multi-functional unit, capable of meeting home comfort requests, including space cooling, space heating, domestic water heating, and energy storage. The configuration shown in FIG. 2 can actively adjust charge allocation and thus optimize operational efficiencies across six modes of operation: (1) space cooling mode; (2) cooling energy charge/defrost mode; (3) cooling storage discharge mode; (4) space heating mode; (5) heat energy charge mode; and (6) heating storage discharge mode. The reversing valves 40, 52 switch among the operation modes and control refrigerant flow directions, while the electronic expansion valves 41, 43, 50 allocate refrigerant mass in active components, while excess charge is stored in the suction line accumulator 38.

Operation of the heat pump across the six modes of operation will now be described. As shown in the drawings, bold flow lines depict cold refrigerant, thin flow lines depict warm refrigerant, and broken flow lines depict the absence of flow. In a dedicated space cooling mode, shown in FIG. 2, the indoor heat exchanger coil 70 operates as an evaporator coil and the outdoor heat exchanger coil 71 operates as a condenser coil. The refrigerant flow to the refrigerant-to-water heat exchanger 44 is shut-off by its upstream third electronic expansion valve 50. The first expansion valve 41 (upstream of the indoor heating coil 70) controls a 5.6K superheat degree at the evaporator exit. The second electronic expansion valve 43 is fully open or is bypassed by the second check valve 56 (each of the check valves are one-way check valves). Both of the indoor blower fan 68 and the outdoor blower fan 69 drive target air flow rates, respectively. As a result, the indoor heat exchanger 32 absorbs heat from the indoor air as it passes over the evaporator coil 70, and the outdoor heat exchanger 34 releases the absorbed heat to the outside air. The liquid refrigerant returns to the evaporator coil 70.

In a cooling energy charge mode (FIG. 3), water circulates from the PCM storage module 46 to the refrigerant-to-water heat exchanger 44. This heat exchanger 44 operates as an evaporator with its upstream expansion valve 50 to control around 5.6K exit superheat degree. The indoor blower 68 remains off, while the first electronic expansion valve 41 controls an optimum subcooling degree out of the outdoor air coil 71, which operates as a condenser with the outdoor fan 69 driving a target air flow rate. The indoor coil 70 and the suction line accumulator 38 operates as a charge buffer. The chilled water stores cooling energy in the PCM storage module 46. The same mode and flow path can defrost the outdoor coil, e.g., obtaining energy from the PCM rather than indoor air to eliminate the cold blow of a typical heat pump during defrosting operations. Alternatively, the same mode and flow path can provide simultaneous space cooling and cooling energy-charge with the indoor blower 68 on.

In a cooling storage discharge mode (FIG. 4), the refrigerant-to-water heat exchanger operates as a condenser to melt the PCM. The indoor blower 68 is on and the indoor air coil 70 operates as an evaporator, with its upstream electronic expansion valve 41 being used to control around 5.6K superheat degree. The outdoor blower 69 is off, while the second expansion valve 43 controls an optimum subcooling degree out of the refrigerant-to-water heat exchanger 44. In the space heating mode (FIG. 5), the indoor coil 70 operates as a condenser and the outdoor coil 71 also acts as an evaporator. The second electronic expansion valve 43 controls an optimum subcooling degree while storing extra refrigerant in the suction line accumulator. In addition, the refrigerant flow to the refrigerant-to-water heat exchanger 44 is turned off by the third expansion valve 50. The water flow is generally off but can run occasionally to maintain the temperature of the phase change material in the hydronic loop 42 above freezing.

In a heating energy charge mode (FIG. 6), the refrigerant-to-water heat exchanger 44 operates as a condenser to heat water and to store energy in the PCM, and the outdoor coil 71 operates as an evaporator to absorb heat from the outside air. The second electronic expansion valve 43 controls around 5.6K superheat degree exiting the outdoor coil 71. The indoor coil 70 remains off, and the first electronic expansion valve 41 controls an optimum subcooling degree out of the condenser 44. The indoor coil 70 and the suction line accumulator 38 provide a charge buffer. Lastly, in a heating storage discharge mode (FIG. 7), the refrigerant-to-water heat exchanger 44 operates as an evaporator, circulating chilled water and exchanging energy with the PCM. The third expansion valve 50 controls a 5.6K superheat degree out of the evaporator, while the indoor coil 70 operates as a condenser with the indoor blower 68 driving a target indoor air flow rate and delivering heating capacity to the indoor space. The outdoor fan 69 is off, with the second expansion valve 43 controlling an optimum subcooling degree out of the condenser 70. In this mode of operation, the outdoor coil 71 and the suction line accumulator 38 provide a charge buffer.

In certain modes of operation, water within the hydronic loop 42 transfers heat to and from the PCM (contained within the PCM storage module 46) to absorb or release significant amounts of heat during a phase transition of the PCM, such as changing from a solid to a liquid or vice versa. That is, the PCM absorbs or releases heat during its phase transition, helping to store or release energy. Suitable PCMs can include, for example, water, glycerol, salt hydrates, or paraffin wax, by non-limiting example. Glycerol can also be mixed with water or used in its pure form, having a relatively low melting point. Salt hydrates can include for example sodium sulfate decahydrate and magnesium sulfate heptahydrate. Other PCMs can be used in other embodiments as desired, and the present invention is not limited to a particular PCM. The PCM storage module 46 is optionally a PCM storage tank or PCM panels in building floors, walls, or drop ceilings.

To reiterate, the control circuitry 60 is communicatively coupled with the four-way reversing valves 40, 52, the electronic expansion valves 41, 43, 50, the pump 48, and the blower fans 68, 69 to cause the ASHP 30 to operate across each of the six modes of operation described above. Generally, the control circuitry 60 selects among the six available modes of operation based on the existing heating and/or cooling demand(s). The control circuitry 60 alters the flow direction by modulating the first reversing valve 40 and by modulating the second reversing valve 52. In particular, the control circuitry 60 can be communicatively coupled with or integrated into a user interface, for example a digital thermostat, that is configured to receive a user selection of a desired indoor temperature. The control circuitry 60 causes the multi-functional system to provide the appropriate mode of operation to meet the selected indoor air temperature: (1) space cooling mode, (2) dedicated cooling-energy charge, simultaneous space cooling and cooling-energy charge, and heating mode outdoor defrost mode; (3) cooling storage discharge mode; (4) space heating mode; (5) heat energy charge mode; and (6) heating storage discharge mode.

The above description is that of current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

The invention claimed is:

1. A multifunctional system comprising:

an indoor air-to-refrigerant heat exchanger;

an outdoor air-to-refrigerant heat exchanger;

a refrigerant-to-water heat exchanger, wherein the indoor air-to-refrigerant heat exchanger, the outdoor air-to-refrigerant heat exchanger, and the refrigerant-to-water heat exchanger are coupled together in parallel;

a first electronic expansion valve that is series-connected to the indoor air-to-refrigerant heat exchanger, a second electronic expansion valve that is series-connected to the outdoor air-to-refrigerant heat exchanger, and a third electronic expansion valve that is series-connected to the refrigerant-to-water heat exchanger;

a compressor to circulate refrigerant through the indoor air-to-refrigerant heat exchanger, the outdoor air-to-refrigerant heat exchanger, and the refrigerant-to-water heat exchanger;

first and second four-way reversing valves coupled together in series to provide a bidirectional flow path between the first four-way reversing valve and the second four-way reversing valve, wherein the first four-way reversing valve is fluidly coupled to the compressor, the indoor air-to-refrigerant heat exchanger, and the second four-way reversing valve, and wherein the second four-way reversing valve is fluidly coupled to the outdoor air-to-refrigerant heat exchanger and the refrigerant-to-water heat exchanger; and a hydronic loop, the hydronic loop comprising:

the refrigerant-to-water heat exchanger, a storage module configured to store a phase change material therein, wherein the storage module includes a water-carrying channel to allow a thermal exchange between water carried by the water-carrying channel and the phase change material, and a pump configured to circulate water through the storage module and through the refrigerant-to-water heat exchanger, wherein the phase change material is thermally coupled to the refrigerant solely through water circulating in the hydronic loop, such that heat transfer between the refrigerant and the phase change material occurs indirectly via the water carried by the water-carrying channel; and controller circuitry communicatively coupled with the first, second, and third expansion valves, the first and second four-way reversing valves, and the pump, wherein the controller circuitry is configured to modulate the first four-way reversing valve and the second four-way reversing valve to alter refrigerant flow direction and to configure the first, second, and third electronic expansion valves and the pump to selectively provide each one of: space cooling; dedicated cooling-energy charge, simultaneous space cooling and cooling-energy charge, and heating mode outdoor defrost mode; cooling-storage discharge; space heating; heat-energy charge; and heat-storage discharge.

2. The system of claim 1, wherein the controller circuitry is configured to:

present a user interface configured to receive a user input selecting any one of the system's functional modes comprising space cooling, dedicated cooling-energy charge, simultaneous space cooling and cooling-energy charge, heating mode outdoor defrost, cooling-storage discharge, space heating, heat-energy charge, and heat-storage discharge.

3. The system of claim 1, wherein the controller circuitry is configured to:

receive a first user input for the multifunctional system to provide space cooling, and in response to the received first user input, cause the first, second, and third expansion valves, the first and second four-way reversing valves, and the pump to provide space cooling.

4. The system of claim 1, wherein the controller circuitry is configured to:

receive a second user input for the multifunctional system to provide dedicated cooling-energy charge, simultaneous space cooling and cooling-energy charge, or heating mode outdoor defrost, and in response to the received second user input, cause the first, second, and third expansion valves, the first and second four-way reversing valves, and the pump to provide dedicated cooling-energy charge, simultaneous space cooling and cooling-energy charge, or heating mode outdoor defrost.

5. The system of claim 1, wherein the controller circuitry is configured to:

receive a third user input for the multifunctional system to provide cooling-storage discharge, and in response to the received third user input, cause the first, second, and third expansion valves, the first and second four-way reversing valves, and the pump to provide cooling-storage discharge.

6. The system of claim 1, wherein the controller circuitry is configured to:

receive a fourth user input for the multifunctional system to provide space heating, and in response to the received fourth user input, cause the first, second, and third expansion valves, the first and second four-way reversing valves, and the pump to provide space heating.

7. The system of claim 6, wherein the controller circuitry is configured to turn off the pump in response to receiving the first user input or the fourth user input.

8. The system of claim 1, wherein the controller circuitry is configured to:

receive a fifth user input for the multifunctional system to provide heat-energy charge, and in response to the received fifth user input, cause the first, second, and third expansion valves, the first and second four-way reversing valves, and the pump to provide heat-energy storage.

9. The system of claim 4, wherein the controller circuitry is configured to turn off the indoor air-to-refrigerant heat exchanger in response to receiving the second user input or the fifth user input.

10. The system of claim 1, wherein the controller circuitry is configured to:

receive a sixth user input for the multifunctional system to provide heat-storage discharge, and in response to the received sixth user input, cause the first, second, and third expansion valves, the first and second four-way reversing valves, and the pump to provide heat-storage discharge.

11. The system of claim 5, wherein the controller circuitry is configured to turn off the outdoor air-to-refrigerant heat exchanger in response to receiving the third user input or the sixth user input.

12. The system of claim 1, wherein the refrigerant-to-water heat exchanger includes a brazed plate water heater.

13. The system of claim 1, further comprising a suction line accumulator coupled to an input side of the compressor.

14. An air source heat pump comprising:

a compressor configured to compress a refrigerant;

an indoor air-to-refrigerant heat exchanger configured to receive the refrigerant from the compressor along an indoor line;

an outdoor air-to-refrigerant heat exchanger configured to receive the refrigerant from the compressor along an outdoor line;

a refrigerant-to-water heat exchanger configured to receive the refrigerant from either of the indoor line or the outdoor line for transferring heat to a supply of water;

a hydronic loop comprising a closed loop through the refrigerant-to-water heat exchanger, the hydronic loop including a storage module containing a phase change material therein, the hydronic loop further including a pump configured to circulate the supply of water through the storage module and through the refrigerant-to-water heat exchanger, wherein the phase change material is thermally coupled to the refrigerant solely through the water circulating in the hydronic loop, such that heat transfer between the refrigerant and the phase change material occurs indirectly via the water circulating in the hydronic loop;

a first electronic expansion valve that is series-connected to the indoor air-to-refrigerant heat exchanger, a second electronic expansion valve that is series-connected to the outdoor air-to-refrigerant heat exchanger, and a third electronic expansion valve that is series-connected to the refrigerant-to-water heat exchanger; and a controller module communicatively coupled with a first four-way reversing valve and a second four-way reversing valve for selectively routing the refrigerant from a discharge side of the compressor to the indoor air-to-refrigerant heat exchanger, the outdoor air-to-refrigerant heat exchanger, and the refrigerant-to-water heat exchanger;

wherein the first four-way reversing valve and the second four-way reversing valve are coupled together in series to provide a bidirectional flow path between the first four-way reversing valve and the second four-way reversing valve, wherein the first four-way reversing valve is fluidly coupled to the compressor, the indoor air-to-refrigerant heat exchanger, and the second four-way reversing valve, and wherein the second four-way reversing valve is fluidly coupled to the outdoor air-to-refrigerant heat exchanger and the refrigerant-to-water heat exchanger; and wherein the controller module is configured to modulate the first four-way reversing valve and the second four-way reversing valve to alter refrigerant flow direction and to configure the first, second, and third electronic expansion valves and the pump to selectively provide each one of: space cooling; dedicated cooling-energy charge, simultaneous space cooling and cooling-energy charge, and heating mode outdoor defrost mode; cooling-storage discharge; space heating; heat-energy charge; and heat-storage discharge.

15. The heat pump of claim 14, further comprising a suction line accumulator coupled directly with a suction side of the compressor.

16. The heat pump of claim 14, wherein the refrigerant-to-water heat exchanger comprises a brazed plate water heater.

17. The heat pump of claim 14, wherein each of the indoor air-to-refrigerant heat exchanger and the outdoor air-to-refrigerant heat exchanger comprise a coil and a fan.

18. The heat pump of claim 14, wherein the indoor air-to-refrigerant heat exchanger and the first electronic expansion valve are in fluid communication with each other along the indoor line.

19. The heat pump of claim 14, wherein the outdoor air-to-refrigerant heat exchanger and the second electronic expansion valve are in fluid communication with each other along the outdoor line.

20. The heat pump of claim 14, wherein the phase change material comprises water, glycerol, salt hydrates, or paraffin wax.

21. The heat pump of claim 14, wherein the storage module comprises a ceiling panel, a floor panel, or a wall panel containing the phase change material therein.

22. The heat pump of claim 14, wherein the storage module comprises a storage tank containing the phase change material therein.

* * * * *